US008865386B2

(12) United States Patent
Kawauchi et al.

(10) Patent No.: US 8,865,386 B2
(45) Date of Patent: Oct. 21, 2014

(54) CARRIER CORE PARTICLE FOR ELECTROPHOTOGRAPHIC DEVELOPER, CARRIER FOR ELECTROPHOTOGRAPHIC DEVELOPER AND ELECTROPHOTOGRAPHIC DEVELOPER

(75) Inventors: Takeshi Kawauchi, Okayama (JP); Sho Ogawa, Okayama (JP)

(73) Assignees: Dowa Electronics Materials Co., Ltd., Tokyo (JP); Dowa IP Creation Co., Ltd., Okayama (JP)

( * ) Notice: Subject to any disclaimer, the term of this patent is extended or adjusted under 35 U.S.C. 154(b) by 0 days.

(21) Appl. No.: 13/579,777

(22) PCT Filed: Mar. 29, 2011

(86) PCT No.: PCT/JP2011/057796

§ 371 (c)(1),
(2), (4) Date: Aug. 17, 2012

(87) PCT Pub. No.: WO2011/125647

PCT Pub. Date: Oct. 13, 2011

(65) Prior Publication Data

US 2013/0011780 A1 Jan. 10, 2013

(30) Foreign Application Priority Data

Mar. 31, 2010 (JP) ..... 2010-083698

(51) Int. Cl.

| | |
|---|---|
| ***G03G 9/113*** | (2006.01) |
| ***G03G 9/10*** | (2006.01) |
| ***G03G 9/107*** | (2006.01) |

(52) U.S. Cl.

CPC ..... *G03G 9/107* (2013.01); *G03G 9/10* (2013.01); *G03G 9/1075* (2013.01); *G03G 9/1132* (2013.01)

USPC ..... 430/111.32; 430/111.3; 430/111.31; 430/111.33

(58) Field of Classification Search

CPC ..... G03G 9/10; G03G 9/107; G03G 9/113

USPC ..... 430/111.3, 111.31, 111.32, 111.33

See application file for complete search history.

(56) References Cited

U.S. PATENT DOCUMENTS 5,795,693 A * 8/1998 Okado et al. ..... 430/109.4

FOREIGN PATENT DOCUMENTS

| | | | |
|---|---|---|---|
| CN | 1116733 | 2/1996 | |
| CN | 1159013 | 9/1997 | |
| CN | 101283315 | 10/2008 | |
| CN | 101652721 | 2/2010 | |
| CN | 101663622 | 3/2010 | |
| JP | 2003-207950 | * 7/2003 | ..... G03G 9/107 |
| JP | 2008-241742 | 10/2008 | |

OTHER PUBLICATIONS

Translation of JP 2003-207950 published Jul. 2003.*

* cited by examiner

*Primary Examiner* — Peter Vajda
(74) *Attorney, Agent, or Firm* — Clark & Brody

(57) ABSTRACT

A carrier core particle for an electrophotographic developer includes a core composition expressed by a general formula: $Mn_xFe_{3-x}O_{4+y}$ ($0<x\leq1$, $0<y$) as a main ingredient, 0.1 wt % or more of Si, and 0.03 wt % or more of at least one metal element selected from the group consisting of Ca, Sr and Mg.

4 Claims, 9 Drawing Sheets

11

12

CARRIER CORE PARTICLE FOR ELECTROPHOTOGRAPHIC DEVELOPER, CARRIER FOR ELECTROPHOTOGRAPHIC DEVELOPER AND ELECTROPHOTOGRAPHIC DEVELOPER

TECHNICAL FIELD

This invention relates to a carrier core particle for an electrophotographic developer (hereinafter, sometimes simply referred to as "carrier core particle"), a carrier for an electrophotographic developer (hereinafter, sometimes simply referred to as "carrier"), and an electrophotographic developer (hereinafter, sometimes simply referred to as "developer"). More particularly, this invention relates to a carrier core particle contained in an electrophotographic developer used in copying machines, MFPs (Multifunctional Printers) or other types of electrophotographic apparatuses, a carrier contained in an electrophotographic developer, and an electrophotographic developer.

BACKGROUND ART

Electrophotographic dry developing systems employed in a copying machine, MFP or other types of electrophotographic apparatuses are categorized into a system using a one-component developer containing only toner and a system using a two-component developer containing toner and carrier. In either of these developing systems, toner charged to a predetermined level is applied to a photoreceptor. An electrostatic latent image formed on the photoreceptor is rendered visual with the toner and is transferred to a sheet of paper. The image visualized by the toner is fixed on the paper to obtain a desired image.

A brief description about development with the two-component developer will be given. A predetermined amount of toner and a predetermined amount of carrier are accommodated in a developing apparatus. The developing apparatus is provided with a plurality of rotatable magnet rollers, which are arranged circumferentially to present alternative south and north poles, and an agitation roller for agitating and mixing the toner and carrier in the developing apparatus. The carrier made of a magnetic powder is carried by the magnet rollers. The magnetic force of the magnet rollers forms a straight-chain like magnetic brush of carrier particles. Agitation produces triboelectric charges that bond a plurality of toner particles to the surface of the carrier particles. The magnetic brush abuts against the photoreceptor with rotation of the magnet rollers and supplies the toner to the surface of the photoreceptor. Development with the two-component developer is carried out as described above.

Fixation of the toner on a sheet of paper results in successive consumption of toner in the developing apparatus, and new toner in the same amount as that of the consumed toner is supplied, whenever needed, from a toner hopper attached to the developing apparatus. On the other hand, the carrier is not consumed for development and used as it is until the carrier comes to the end of its life. The carrier, which is a component of the two-component developer, is required to have various functions including: a function of triboelectrically charging the toner by agitation in an effective manner; an insulating function; and a toner transferring ability to appropriately transfer the toner to the photoreceptor. To improve the toner charging performance, for example, the carrier is required to have appropriate electric resistance (hereinafter, sometimes simply referred to as "resistance") and appropriate insulating properties.

The aforementioned carrier currently made is composed of a carrier core particle, which is a core or a base of the carrier, and a coating resin, which covers the surface of the carrier core particle.

The carrier core particle is desired to have high mechanical strength as basic characteristics. As described above, the carrier is agitated in the developing apparatus, and it is desirable to prevent the carrier from being chipped and cracked by agitation as much as possible. Accordingly, the carrier core particle covered with coating resin is also desired to have high mechanical strength.

In addition, the carrier core particle is desired to have good magnetic properties. Briefly speaking, the carrier is carried by magnet rollers with magnetic force in the developing apparatus. Under the usage, if the magnetism, more specifically, the magnetization of the carrier core particle is low, the retention of the carrier to the magnet rollers becomes low, which may cause so-called scattering of the carrier or other problems. Especially, recent tendencies to make the diameter of a toner particle smaller in order to meet the demand for high-quality image formation require smaller carrier particles. However, the downsizing of the carrier particles could lead to reduction in the retention of each carrier particle. Effective measures are required to prevent the scattering of the carrier.

Among the disclosed various techniques relating to the carrier core particle, Japanese Unexamined Patent Application Publication No. 2008-241742 (PL1) discloses a technique with the aim of preventing the carrier from scattering.

CITATION LIST

Patent Literature

PL1: JP-A No. 2008-241742

SUMMARY OF INVENTION

Technical Problem

The carrier core particle is desired to have good electric properties, more specifically, to hold a large amount of charge and have a high dielectric breakdown voltage. In addition, from the aforementioned viewpoint, the carrier is desired to have an appropriate resistance. Especially, the carrier core particle tends to be greatly desired to have excellent charging performance.

In general, copying machines are installed and used in offices of companies; however, there are various office environments around the world. For instance, some copying machines are used under high-temperature environments at approximately 30° C., while some are used under high-humidity environments at approximately 90% RH. On the contrary, some copying machines are used under low-temperature environments at approximately 10° C., while some are used under low-humidity environments at approximately 35% RH. Even under the conditions with different temperatures and relative humidities, the developer in a developing apparatus of a copying machine is required to reduce the changes in the properties. The carrier core particle, which makes up the carrier particle, is also desired to reduce its property changes in various environments, in other words, to be less dependent on environments.

The inventors of the present invention thoroughly investigated the cause why the properties, such as the amount of charge and resistance values, of the carrier change depending on the usage environment, and found out that the property change of the carrier core particle greatly influences the properties of the coated carrier particle. It has also been found out that the conventional carrier core particles as represented by LP1 are inadequate to reduce environment dependency. Actually, the amount of charge and resistance value of some carrier core particles greatly deteriorate in relatively high relative-humidity environments. Such carrier core particles can be greatly affected by environmental variations and therefore may degrade image quality.

The object of the present invention is to provide a carrier core particle for an electrophotographic developer having high charging performance and low environmental dependency.

Yet another object of the present invention is to provide a carrier for an electrophotographic developer having high charging performance and low environmental dependency.

Yet another object of the present invention is to provide an electrophotographic developer capable of forming good quality images under various environments.

Solution to Problem

For the purpose of achieving a carrier core particle having high charging performance and low environmental dependency, the inventors of the present invention firstly conceived to use manganese and iron as main ingredients of the core composition to obtain good magnetic properties as basic characteristics and secondly conceived to add a trace amount of $SiO_2$ small enough not to impair the magnetic properties, but enough to impart high mechanical strength. As a result of keen examination, the inventors concluded that, among the $SiO_2$ added to improve mechanical strength, Si existing as an oxide on the surface of the carrier core particle adversely affects environmental dependency. More specifically, Si as an oxide positioned on the surface of the carrier core particle adsorbs moisture contained in a relatively large amount in high-humidity environments and induces charge leakage, resulting in reduction of resistance under the high humidity environments. The inventors also found out that the inherently low triboelectric-charge retention of $SiO_2$ in the carrier core particle might degrade the charging performance of the carrier core particle. In order to reduce the adverse effects, possibly caused by Si, on the environmental dependency and charging performance, a predetermined amount of a predetermined metal element is added as a component of the carrier core particle. The metal element is at least one selected from a group consisting of Ca, Sr and Mg and the amount thereof to be contained in the carrier core particle is 0.03 wt % or more. This additive is considered to reduce the environmental dependency and improve the charging performance through the following mechanism. The metal element added in a predetermined amount reacts with Si existing as an oxide positioned on the surface of the carrier core particle to form a complex metal oxide. The complex metal oxide derived from Si is considered to prevent charge leakage under the high-humidity environments and reduction in resistance of the carrier core particle, thereby lowering environmental dependency. It is also considered that the Si complex metal oxide, which is made of Si and a predetermined metal element, and the metal element can retain triboelectric charge to improve the charging performance of the carrier core particle. In addition, an excess amount of oxygen is added into the core composition, or the carrier core particle, to further reduce environmental dependency.

Accordingly, the carrier core particle for an electrophotographic developer of the present invention includes a core composition expressed by a general formula: $Mn_xFe_{3-x}O_{4+y}$ ($0<x\leq1$, $0<y$) as a main ingredient, 0.1 wt % or more of Si, and 0.03 wt % or more of at least one metal element selected from the group consisting of Ca, Sr, and Mg.

The carrier core particle is expressed by a general formula: $Mn_xFe_{3-x}O_{4+y}$ ($0<x\leq1$, $0<y$). This represents that the amount of oxygen satisfies $0<y$ and therefore the carrier core particle contains slightly excess oxygen. Such a carrier core particle can prevent reduction in resistance in high-humidity environments. The carrier core particle according to the invention further contains 0.1 wt % or more of Si and 0.03 wt % or more of at least one metal element selected from the group consisting of Ca, Sr and Mg.

Such a carrier core particle has, as described above, high charging performance and low environmental dependency.

A method for calculating an oxygen amount y will be described. Before calculating the oxygen amount y, Mn is assumed to be divalent in the present invention. First, the average valence of Fe is calculated. The average valence of Fe is obtained by quantifying $Fe^{2+}$ and total Fe through oxidation-reduction titration and then calculating the average valence of Fe from the resultant quantities of $Fe^{2+}$ and $Fe^{3+}$. The quantification of $Fe^{2+}$ and total Fe will be described in detail.

(1) Quantification of $Fe^{2+}$

First, ferrite containing iron elements is dissolved in a hydrochloric acid (HCl) solution, which is reducible acid, with carbon dioxide bubbling. Secondly, the amount of $Fe^{2+}$ ion in the solution is quantitatively analyzed through potential difference titration with potassium permanganate solution, thereby obtaining the titer of $Fe^{2+}$.

(2) Quantification of Total Fe

Iron-element containing ferrite, which weighs the same amount as the ferrite used to quantify $Fe^{2+}$, is dissolved in mixed acid solution of hydrochloric acid and nitric acid. This solution is evaporated to dryness, and then a sulfuric acid solution is added to the solution for redissolution to volatilize excess hydrochloric acid and nitric acid. Solid Al is added to the remaining solution to reduce the $Fe^{2+}$ in the solution to $Fe^{2+}$. Subsequently, the solution is measured by the same analysis method used to quantify $Fe^{2+}$ to obtain the titer of the total Fe.

(3) Calculation of Average Valence of Fe

The description (1) provides the determinate quantity of $Fe^{2+}$, and therefore ((2) titer−(1) titer) represents the quantity of $Fe^{3+}$. The following formula determines the average valence number of Fe.

$$\text{The average valence of Fe}=\{3\times((2)\text{ titer}-(1)\text{ titer})+2\times(1)\text{ titer}\}/(2)\text{ titer}$$

In addition to the aforementioned method, some different oxidation reduction titration methods are applicable to quantitatively determine the valence of the iron element; however, the aforementioned method is regarded as superior to others because the reaction required for analysis is simple, the results can be read easily, a general reagent and analysis device can achieve sufficient accuracy, and skilled analyzers are not needed.

Based on the electroneutrality principle, the relationship, Mn valence (valence of +2)×x+average valence of Fe×(3−x)=oxygen valence (valence of −2)×(4+y), is established in a structural formula. From the above formula, the value y is determined.

An analysis method on the Si, Mn, Ca, Mg and Sr of the carrier core particle according to the present invention will be described.

(Analysis on $SiO_2$ Content and Si Content)

The $SiO_2$ content in the carrier core particle was quantitatively analyzed in conformity with the silica gravimetric method shown in JIS M8214-1995. The $SiO_2$ contents in the carrier core particles described in this invention are quantities of $SiO_2$ that were quantitatively analyzed through the silica gravimetric method. The Si contents defined by the present invention were obtained by the following formula with the $SiO_2$ quantities obtained by the analysis.

$$\text{Si content (wt \%)} = SiO_2 \text{ quantity (wt \%)} \times 28.09 \text{ (mol/g)} \div 60.09 \text{ (mol/g)}$$

(Analysis on Mn)

The Mn content in the carrier core particle was quantitatively analyzed in conformity with a ferromanganese analysis method (potential difference titration) shown in JIS G1311-1987. The Mn contents of the carrier core particles described in this invention are quantities of Mn that were quantitatively analyzed through the ferromanganese analysis method (potential difference titration).

(Analysis on Ca, Sr and Mg)

The contents of Ca, Sr and Mg in the carrier core particles were analyzed by the following method. The carrier core particles of the invention were dissolved in an acid solution and quantitatively analyzed with ICP. The contents of Ca, Sr and Mg in the carrier core particles described in this invention are quantities of Ca, Sr and Mg that were quantitatively analyzed with the ICP.

Preferably, the molar ratio of the metal element to be added against Si is 0.09 or higher. This means that the metal element being added is greater in amount than Si thereby to reduce the ratio of Si existing in the oxide, and therefore the carrier core particle is considered to improve the charging performance and reduce environmental dependency.

Another aspect of the present invention is directed to a carrier for an electrophotographic developer used to develop electrophotographic images and including a carrier core particle having a core composition expressed by a general formula: $Mn_xFe_{3-x}O_{4+y}$ ($0<x\leq1$, $0<y$) as a main ingredient, 0.1 wt % or more of Si, and 0.03 wt % or more of at least one metal element selected from the group consisting of Ca, Sr and Mg, and a resin that coats the surface of the carrier core particle for the electrophotographic developer. Such a carrier for the electrophotographic developer including the carrier core particle having the aforementioned composition has high charging performance and low environmental dependency.

Yet another aspect of the present invention is directed to an electrophotographic developer used to develop electrophotographic images and including a carrier having a carrier core particle having a core composition expressed by a general formula: $Mn_xFe_{3-x}O_{4+y}$ ($0<x\leq1$, $0<y$) as a main ingredient, 0.1 wt % or more of Si, and 0.03 wt % or more of at least one metal element selected from the group consisting of Ca, Sr and Mg, and a resin that coats the surface of the carrier core particle for the electrophotographic developer, and a toner that can be triboelectrically charged by frictional contact with the carrier for development of electrophotographic images. Such an electrophotographic developer having the carrier thus composed can form images with excellent quality in various environments.

Advantageous Effects of Invention

The carrier core particle for an electrophotographic developer according to the invention has high charging performance and low environmental dependency.

The carrier for the electrophotographic developer according to the invention has high charging performance and low environmental dependency.

The electrophotographic developer according to the invention can form good quality images under various environments.

DESCRIPTION OF EMBODIMENTS

Figure 1:
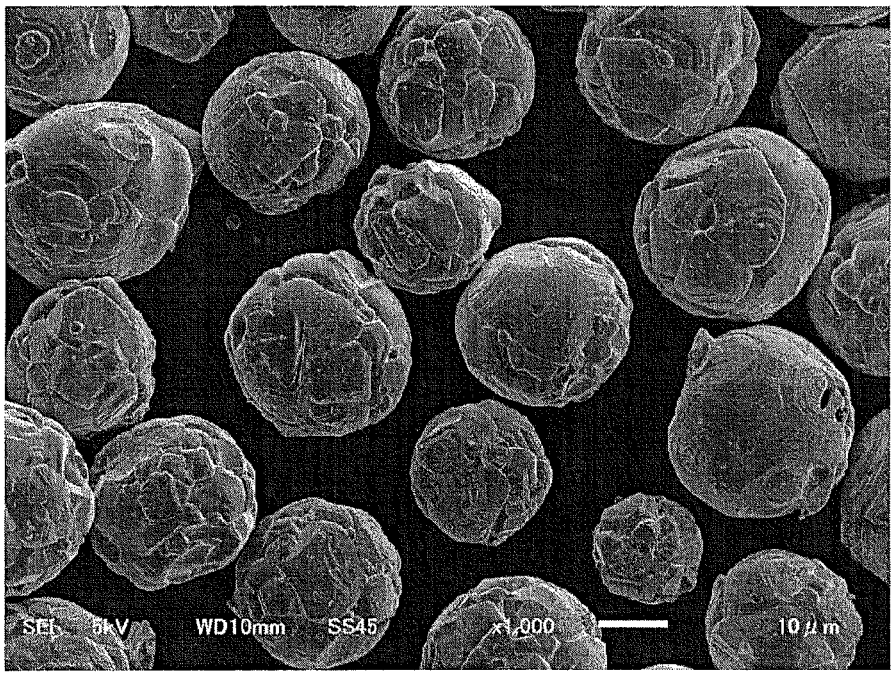
FIG. 1 is an electron micrograph showing the external appearance of a carrier core particle according to an embodiment of the invention.

With reference to the drawings, an embodiment of the present invention will be described. First, a carrier core particle according to the embodiment of the invention will be described. FIG. 1 is an electron micrograph showing the external appearance of a carrier core particle according to the embodiment of the invention.

Referring to FIG. 1, a carrier core particle 11 according to the embodiment of the invention are roughly spherical in shape, approximately 35 μm in diameter, and have proper particle size distribution. The diameter of the carrier core particle implies a volume mean diameter. The diameter and particle size distribution are set to any values to satisfy the required developer characteristics, yields of manufacturing steps and some other factors. On the surface of the carrier core particle 11, there are fine asperities formed in a firing step which will be described later.

Figure 2:
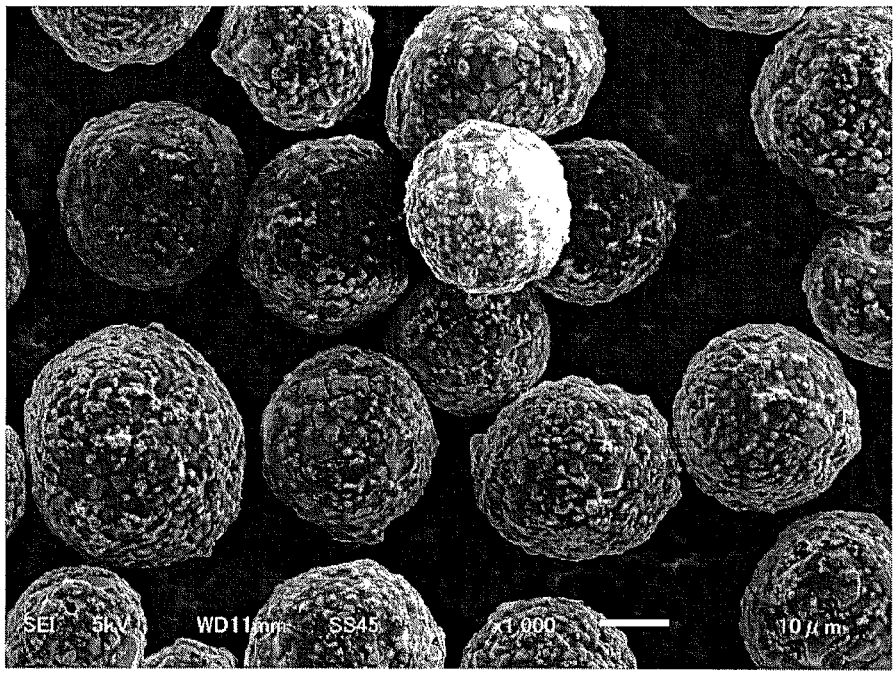
FIG. 2 is an electron micrograph showing the external appearance of a carrier according to the embodiment of the invention.

FIG. 2 is an electron micrograph showing the external appearance of a carrier according to the embodiment of the invention. Referring to FIG. 2, the carrier 12 of the embodiment of the invention is roughly spherical in shape as with the carrier core particles 11. The carrier 12 is made by coating, or covering, the carrier core particle 11 with a thin resin film and has almost the same diameter as the carrier core particle 11. The surface of the carrier 12 is almost completely covered with resin, which is different from the carrier core particle 11.

Figure 3:
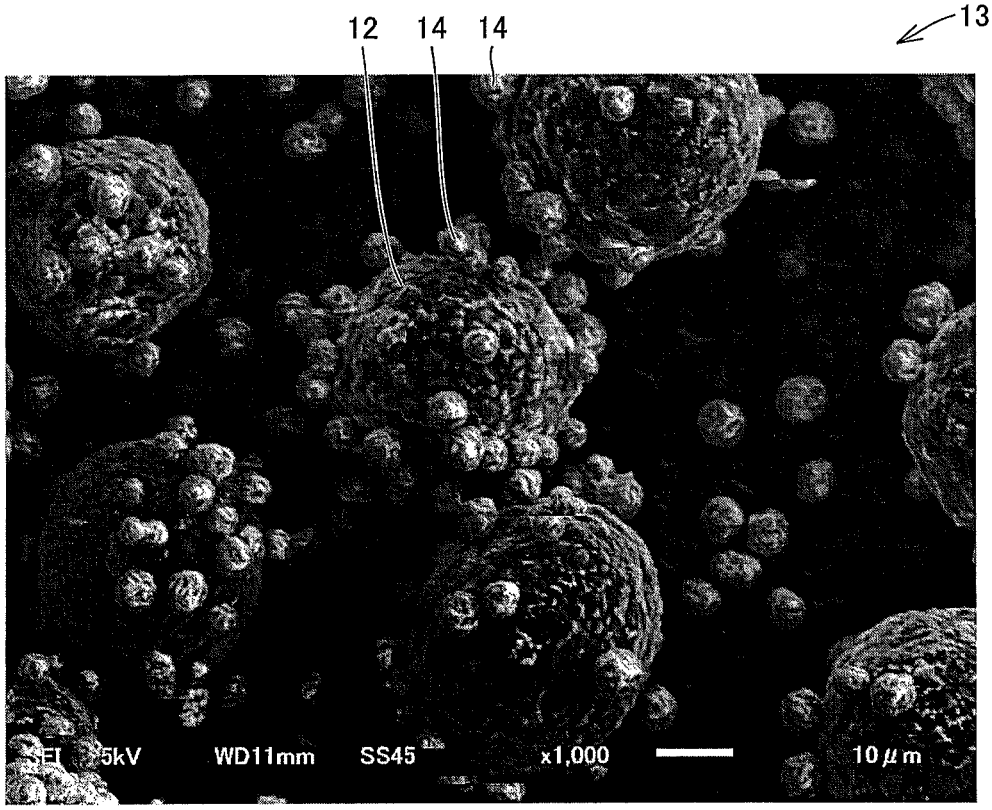
FIG. 3 is an electron micrograph showing the external appearance of developer according to the embodiment of the invention.

FIG. 3 is an electron micrograph showing the external appearance of developer according to the embodiment of the invention. Referring to FIG. 3, the developer 13 includes the carrier 12 shown in FIG. 2 and toner 14. The toner 14 is also roughly spherical in shape. The toner 14 contains mainly styrene acrylic-based resin or polyester-based resin and a predetermined amount of pigment, wax and other ingredients combined therewith. The toner 14 of this type is manufactured by, for example, a pulverizing method or polymerizing method. The toner 14 in use is, for example, approximately 5 μm in diameter, which is about one-seventh of the diameter of the carrier 12. The compounding ratio of the toner 14 and carrier 12 is also set to any value according to the required developer characteristics. The developer 13 of this type is manufactured by mixing a predetermined amount of the carrier 12 and toner 14 by a suitable mixer.

Figure 4:
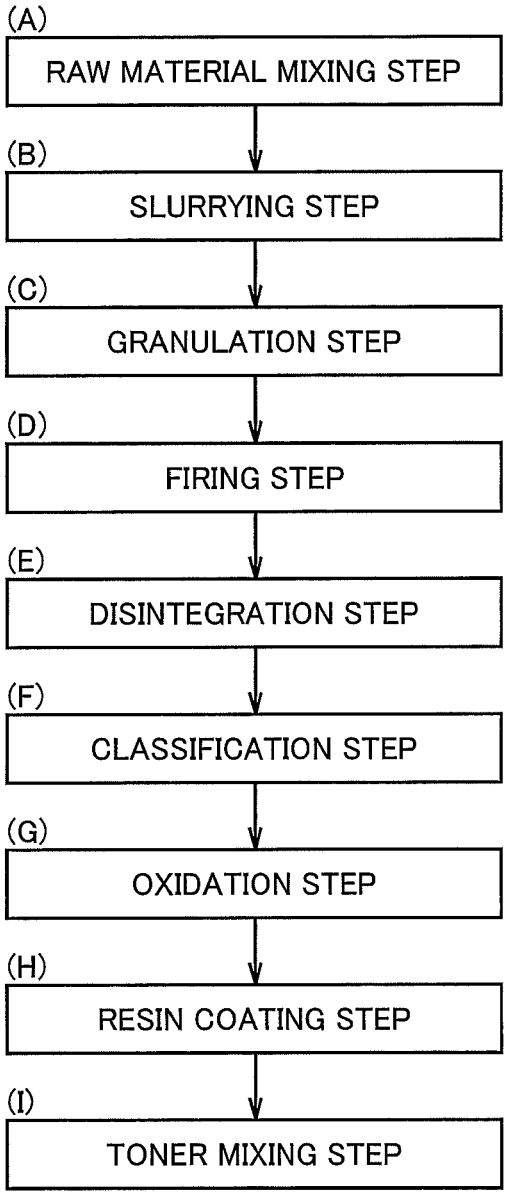
FIG. 4 is a flow chart showing main steps of a method for manufacturing the carrier core particle according to the embodiment of the invention.

A method for manufacturing the carrier core particle according to the embodiment of the invention will be described. FIG. 4 shows a flow chart of main steps in the method for manufacturing the carrier core particle according to the embodiment of the invention. Along FIG. 4, the method for manufacturing the carrier core particle according to the embodiment of the invention will be described below.

First, at least one raw material selected from a raw material containing calcium, a raw material containing strontium and a raw material containing magnesium, and a raw material containing manganese, a raw material containing iron and a raw material containing Si (silicon) are prepared. The prepared raw materials are formulated at an appropriate compounding ratio to meet the required characteristics, and mixed (FIG. 4(A)). The appropriate compounding ratio is designed so that the final carrier core particle contains 0.1 wt % or more of Si and 0.03 wt % or more of at least one metal element selected from the group consisting of Ca, Sr and Mg.

The iron raw material making up the carrier core particle according to the embodiment of the invention can be metallic iron or an oxide thereof, and more specifically, preferred materials include $Fe_2O_3$, $Fe_3O_4$ and Fe, which can stably exist at room temperature and atmospheric pressure. The manganese raw material can be manganese metal or an oxide thereof, and more specifically, preferred materials include Mn metal, $MnO_2$, $Mn_2O_3$, $Mn_3O_4$, and $MnCO_3$, which can stably exist at room temperature and atmospheric pressure. Preferably used raw materials containing calcium include calcium metal or oxide thereof, more specifically, $CaCO_3$, which is a carbonate, $Ca(OH)_2$, which is a hydroxide, CaO, which is an oxide, and so on. Preferably used raw materials containing strontium include strontium metal or oxide thereof, more specifically, $SrCO_3$, which is a carbonate and so on. Preferably used raw materials containing magnesium include magnesium metal or oxide thereof, more specifically, $MgCO_3$, which is a carbonate, $Mg(OH)_2$, which is a hydroxide, MgO, which is an oxide, and so on. For the raw material containing Si, $SiO_2$ is preferable from the viewpoint of handleability. Preferable $SiO_2$ raw materials to be added include amorphous silica, crystalline silica, colloidal silica and so on. Alternatively, the aforementioned raw materials (iron raw material, manganese raw material, calcium raw material, strontium raw material, magnesium raw material, Si-containing raw material, etc.) can be used respectively or can be mixed so as to obtain a target composition. The raw material of choice can be calcined and pulverized before use.

Next, the mixed raw materials are slurried (FIG. 4(B)). In other words, these raw materials are weighed to make a target composition of the carrier core particle and mixed together to make a slurry raw material.

In the process for manufacturing the carrier core particle according to the invention, a reducing agent may be added to the slurry raw material at a part of a firing step, which will be described later, to accelerate reduction reaction. A preferred reducing agent may be carbon powder, polycarboxylic acid-based organic substance, polyacrylic acid-based organic substance, maleic acid, acetic acid, polyvinyl alcohol (PVA)-based organic substance, or mixtures thereof.

Water is added to the slurry raw material that is then mixed and agitated so as to contain 40 wt % or more of solids, preferably 50 wt % or more. The slurry raw material containing 50 wt % or more of solids is preferable because such a material can maintain the strength of granulated pellets.

Subsequently, the slurried raw material is granulated (FIG. 4(C)). Granulation of the slurry obtained by mixing and agitation is performed with a spray drier. Note that it is preferable to subject the slurry to wet pulverization before the granulation step.

The temperature of an atmosphere during spray drying can be set to approximately 100° C. to 300° C. This can provide granulated powder whose particles are approximately 10 to 200 μm in diameter. In consideration of the final particle diameter of a product, it is preferable to filter the granulated powder with a vibrating sieve or the like to remove coarse particles and fine powder for particle size adjustment at this point of time.

The granulated material is then fired (FIG. 4(D)). Specifically, the obtained granulated powder is placed in a furnace heated to approximately 900° C. to 1500° C. and fired for 1 to 24 hours to produce a target fired material. During firing, the oxygen concentration in the firing furnace can be set to any value, but should be enough to advance ferritization reaction. Specifically speaking, when the furnace is heated to 1200° C., a gas is introduced and flows in the furnace to adjust the oxygen concentration to $10^{-7}$% to 3%.

Alternatively, a reduction atmosphere required for ferritization can be made by adjusting the aforementioned reducing agent. To achieve a reaction speed that provides sufficient productivity in an industrial operation, the preferable temperature is 900° C. or higher. If the firing temperature is 1500° C. or lower, the particles are not excessively sintered and can remain in the form of powder upon completion of firing.

One of the measures of adding a slightly excess amount of oxygen in the core composition may be to set the oxygen concentration during cooling of the core particles in the firing step to a predetermined value or higher. Specifically, the core particles are cooled to approximately room temperature in the firing step under an atmosphere at a predetermined oxygen concentration, for example, at an oxygen concentration higher than 0.03%. More specifically, a gas with an oxygen concentration higher than 0.03% is introduced into the electric furnace and continues flowing during the cooling step. This allows the internal layer of the carrier core particle to contain ferrite with an excess amount of oxygen. If the oxygen concentration of the gas is 0.03% or lower in the cooling step, the amount of oxygen in the internal layer becomes relatively low. Therefore, the cooling operation should be performed under the environment at the aforementioned oxygen concentration.

It is preferable at this stage to adjust the size of particles of the fired material again. The fired material is coarsely ground by a hammer mill or the like. In other words, the fired granules are disintegrated (FIG. 4(E)). After disintegration, classification is carried out with a vibrating sieve or the like. In other words, the disintegrated granules are classified (FIG. 4(F)) to obtain carrier core particles with a predetermined diameter.

Then, the classified granules undergo oxidation (FIG. 4(G)). The surfaces of the carrier core particles obtained at this stage are heat-treated (oxidized) to increase the breakdown voltage to 250 V or higher, thereby imparting an appropriate electric resistance value, from $1\times10^{6}$ to $1\times10^{13}$ Ω·cm, to the carrier core particles. Increasing the electric resistance value of the carrier core particle through oxidation can reduce the possibility of scattering of the carrier caused by charge leakage.

More specifically, the granules are placed in an atmosphere at an oxygen concentration of 10% to 100%, at a temperature of 200° C. to 700° C., for 0.1 to 24 hours to obtain the target carrier core particle. More preferably, the granules are placed at a temperature of 250° C. to 600° C. for 0.5 to 20 hours, further more preferably, at a temperature of 300° C. to 550° C. for 1 to 12 hours. In this manner, the carrier core particle according to the embodiment of the invention is manufactured. Note that the oxidation step is optionally executed when necessary.

The carrier core particle thus obtained is coated with resin (FIG. 4(H)). Specifically, the carrier core particle obtained according to the invention is coated with silicone-based resin, acrylic resin, or the like. The carrier for an electrophotographic developer according to the embodiment of the invention is achieved in this manner. The coating with silicone-based resin, acrylic resin or the like can be done by well-known techniques. The carrier for the electrophotographic developer according to the invention includes a carrier core particle having a core composition expressed by a general formula: $Mn_xFe_{3-x}O_{4+y}$ ($0<x\leq1$, $0<y$) as a main ingredient, 0.1 wt % or more of Si, and 0.03 wt % or more of at least one metal element selected from the group consisting of Ca, Sr and Mg, and a resin that coats the surface of the carrier core particle for the electrophotographic developer.

The carrier for the electrophotographic developer that includes the carrier core particle having the aforementioned composition has high charging performance and low environmental dependency.

Next, the carrier thus obtained and toner are mixed in predetermined amounts (FIG. 4(I)). Specifically, the carrier, which is obtained through the above mentioned manufacturing method, for the electrophotographic developer according to the invention is mixed with an appropriate well-known toner. In this manner, the electrophotographic developer according to the embodiment of the invention can be achieved. The carrier and toner are mixed by any mixer, for example, a ball mill. The electrophotographic developer according to the invention is used to develop electrophotographic images and contains the carrier and toner, the carrier including a carrier core particle that has a core composition expressed by a general formula: $Mn_xFe_{3-x}O_{4+y}$ ($0<x\leq1$, $0<y$), 0.1 wt % or more of Si, and 0.03 wt % or more of at least one metal element selected from the group consisting of Ca, Sr and Mg, and a resin that coats the surface of the carrier core particle, and the toner that can be triboelectrically charged by frictional contact with the carrier for development of electrophotographic images.

Such an electrophotographic developer that includes the carrier having the aforementioned composition can form high quality images in various environments.

EXAMPLE

Example 1

10.8 kg of $Fe_2O_3$ (average particle diameter: 0.6 μm) and 4.2 kg of $Mn_3O_4$ (average particle diameter: 2 μm) were dispersed in 5.0 kg of water, and 90 g of ammonium polycarboxylate-based dispersant, 45 g of carbon black reducing agent, 30 g of colloidal silica as $SiO_2$ raw material (solid concentration of 50%) and 15 g of $CaCO_3$ were added to make a mixture. The solid concentration of the mixture was measured and results in 75 wt %. The mixture was pulverized by a wet ball mill (media diameter: 2 mm) to obtain mixture slurry.

The slurry was sprayed into hot air of approximately 130° C. by a spray dryer and turned into dried granulated powder. At this stage, granulated powder particles out of the target particle size distribution were removed by a sieve. This granulated powder was placed in an electric furnace and fired at 1130° C. for three hours. During firing, gas was controlled to flow in the electric furnace such that the atmosphere in the electric furnace was adjusted to have an oxygen concentration of 0.8%. The obtained fired material was disintegrated and then classified by a sieve, thereby obtaining carrier core particles of Example 1 whose average particle diameter is 25 μm. The resultant carrier core particle was then maintained in an atmosphere at 470° C. for one hour for oxidation to obtain the carrier core particle of Example 1. The physical properties, magnetic properties and electric properties of the resultant carrier core particle will be shown in Tables 1 and 2. Note that the core composition listed in Table 1 was obtained by measuring the carrier core particle through the aforementioned analysis method.

Example 2

The carrier core particle of Example 2 was obtained in the same manner as in Example 1, but the added $CaCO_3$ was 38 g. The physical properties, magnetic properties and electric properties of the resultant carrier core particle will be shown in Tables 1 and 2. Note that the core composition listed in Table 1 was obtained by measuring the carrier core particle through the aforementioned analysis method.

Example 3

The carrier core particle of Example 3 was obtained in the same manner as in Example 1, but the added $CaCO_3$ was 75 g. The physical properties, magnetic properties and electric properties of the resultant carrier core particle will be shown in Tables 1 and 2. Note that the core composition listed in Table 1 was obtained by measuring the carrier core particle through the aforementioned analysis method.

Example 4

The carrier core particle of Example 4 was obtained in the same manner as in Example 1, but the added $CaCO_3$ was 150 g. The physical properties, magnetic properties and electric properties of the resultant carrier core particle will be shown in Tables 1 and 2. Note that the core composition listed in Table 1 was obtained by measuring the carrier core particle through the aforementioned analysis method.

Example 5

The carrier core particle of Example 5 was obtained in the same manner as in Example 1, but $CaCO_3$ was replaced with 15 g of $MgCO_3$. The physical properties, magnetic properties and electric properties of the resultant carrier core particle will be shown in Tables 1 and 2. Note that the core composition listed in Table 1 was obtained by measuring the carrier core particle through the aforementioned analysis method.

Example 6

The carrier core particle of Example 6 was obtained in the same manner as in Example 1, but $CaCO_3$ was replaced with 32 g of $MgCO_3$. The physical properties, magnetic properties and electric properties of the resultant carrier core particle will be shown in Tables 1 and 2. Note that the core composition listed in Table 1 was obtained by measuring the carrier core particle through the aforementioned analysis method.

Example 7

The carrier core particle of Example 7 was obtained in the same manner as in Example 1, but $CaCO_3$ was replaced with 63 g of $MgCO_3$. The physical properties, magnetic properties and electric properties of the resultant carrier core particle will be shown in Tables 1 and 2. Note that the core composition listed in Table 1 was obtained by measuring the carrier core particle through the aforementioned analysis method.

Example 8

The carrier core particle of Example 8 was obtained in the same manner as in Example 1, but $CaCO_3$ was replaced with 127 g of $MgCO_3$. The physical properties, magnetic properties and electric properties of the resultant carrier core particle will be shown in Tables 1 and 2. Note that the core composition listed in Table 1 was obtained by measuring the carrier core particle through the aforementioned analysis method.

Example 9

The carrier core particle of Example 9 was obtained in the same manner as in Example 1, but $CaCO_3$ was replaced with 22 g of $SrCO_3$. The physical properties, magnetic properties and electric properties of the resultant carrier core particle will be shown in Tables 1 and 2. Note that the core composition listed in Table 1 was obtained by measuring the carrier core particle through the aforementioned analysis method.

Example 10

The carrier core particle of Example 10 was obtained in the same manner as in Example 1, but $CaCO_3$ was replaced with 55 g of $SrCO_3$. The physical properties, magnetic properties and electric properties of the resultant carrier core particle will be shown in Tables 1 and 2. Note that the core composition listed in Table 1 was obtained by measuring the carrier core particle through the aforementioned analysis method.

Example 11

The carrier core particle of Example 11 was obtained in the same manner as in Example 1, but $CaCO_3$ was replaced with 111 g of $SrCO_3$. The physical properties, magnetic properties and electric properties of the resultant carrier core particle will be shown in Tables 1 and 2. Note that the core composition listed in Table 1 was obtained by measuring the carrier core particle through the aforementioned analysis method.

Example 12

The carrier core particle of Example 12 was obtained in the same manner as in Example 1, but $CaCO_3$ was replaced with 221 g of $SrCO_3$. The physical properties, magnetic properties and electric properties of the resultant carrier core particle will be shown in Tables 1 and 2. Note that the core composition listed in Table 1 was obtained by measuring the carrier core particle through the aforementioned analysis method.

Example 13

6.8 kg of $Fe_2O_3$ (average particle diameter: 0.6 μm) and 3.2 kg of $Mn_3O_4$ (average particle diameter: 2 μm) were dispersed in 3.5 kg of water, and 63 g of ammonium polycarboxylate-based dispersant, 500 g of crystalline silica as $SiO_2$ raw material, and 53 g of $CaCO_3$ were added to make a mixture. Carbon black and other types of reducing agent were not added. The solid concentration of the mixture was measured and results in 75 wt %. The mixture was pulverized by a wet ball mill (media diameter: 2 mm) to obtain mixture slurry.

The slurry was sprayed into hot air of approximately 130° C. by a spray dryer and turned into dried granulated powder. At this stage, granulated powder particles out of the target particle size distribution were removed by a sieve. This granulated powder was placed in an electric furnace and fired at 1100° C. for three hours. During firing, gas was controlled to flow in the electric furnace such that the atmosphere in the electric furnace was adjusted to have an oxygen concentration of 0.8%. The obtained fired material was disintegrated and then classified by a sieve, thereby obtaining a carrier core particle of Example 13 whose average particle diameter is 35 μm. The physical properties, magnetic properties and electric properties of the resultant carrier core particle will be shown in Tables 3 and 4. Note that the core composition listed in Table 3 was obtained by measuring the carrier core particle through the aforementioned analysis method.

Example 14

The carrier core particle of Example 14 was obtained in the same manner as in Example 13, but the added $CaCO_3$ was 105 g. The physical properties, magnetic properties and electric properties of the resultant carrier core particle will be shown in Tables 3 and 4. Note that the core composition listed in Table 3 was obtained by measuring the carrier core particle through the aforementioned analysis method.

Example 15

The carrier core particle of Example 15 was obtained in the same manner as in Example 13, but the added $CaCO_3$ was 210 g. The physical properties, magnetic properties and electric properties of the resultant carrier core particle will be shown in Tables 3 and 4. Note that the core composition listed in Table 3 was obtained by measuring the carrier core particle through the aforementioned analysis method.

Example 16

The carrier core particle of Example 16 was obtained in the same manner as in Example 13, but the added $CaCO_3$ was 525 g. The physical properties, magnetic properties and electric properties of the resultant carrier core particle will be shown in Tables 3 and 4. Note that the core composition listed in Table 3 was obtained by measuring the carrier core particle through the aforementioned analysis method.

Comparative Example 1

The carrier core particle of Comparative Example 1 was obtained in the same manner as in Example 1, but $CaCO_3$ was not added. The physical properties, magnetic properties and electric properties of the resultant carrier core particle will be shown in Tables 1 and 2. Note that the core composition listed in Table 1 was obtained by measuring the carrier core particle through the aforementioned analysis method.

Comparative Example 2

The carrier core particle of Comparative Example 2 was obtained in the same manner as in Example 13, but the added $CaCO_3$ was 5 g and the oxygen concentration in the electric furnace was set to 0.03%. The physical properties, magnetic properties and electric properties of the resultant carrier core particle will be shown in Tables 3 and 4. Note that the core composition listed in Table 3 was obtained by measuring the carrier core particle through the aforementioned analysis method.

Referring to Tables 1 and 2, Example 1 was prepared with x=0.85, Si content of 0.11 wt % and Ca content of 0.05 wt % at an oxygen concentration of 0.8% in the cooling step. Example 2 was prepared with x=0.85, Si content of 0.11 wt % and Ca content of 0.09 wt % at an oxygen concentration of 0.8% in the cooling step. Example 3 was prepared with x=0.85, Si content of 0.11 wt % and Ca content of 0.17 wt % at an oxygen concentration of 0.8% in the cooling step. Example 4 was prepared with x=0.85, Si content of 0.11 wt % and Ca content of 0.33 wt % at an oxygen concentration of 0.8% in the cooling step. Example 5 was prepared with x=0.85, Si content of 0.11 wt % and Mg content of 0.13 wt % at an oxygen concentration of 0.8% in the cooling step. Example 6 was prepared with x=0.85, Si content of 0.11 wt % and Mg content of 0.16 wt % at an oxygen concentration of 0.8% in the cooling step. Example 7 was prepared with x=0.85, Si content of 0.11 wt % and Mg content of 0.20 wt % at an oxygen concentration of 0.8% in the cooling step. Example 8 was prepared with x=0.85, Si content of 0.11 wt % and Ca content of 0.30 wt % at an oxygen concentration of 0.8% in the cooling step. Example 9 was prepared with x=0.85, Si content of 0.11 wt % and Sr content of 0.03 wt % at an oxygen concentration of 0.8% in the cooling step. Example 10 was prepared with x=0.85, Si content of 0.11 wt % and Sr content of 0.13 wt % at an oxygen concentration of 0.8% in the cooling step. Example 11 was prepared with x=0.85, Si content of 0.11 wt % and Sr content of 0.32 wt % at an oxygen concentration of 0.8% in the cooling step. Example 12 was prepared with x=0.85, Si content of 0.11 wt % and Sr content of 0.72 wt % at an oxygen concentration of 0.8% in the cooling step. On the other hand, Comparative Example 1 was prepared with x=0.85, Si content of 0.11 wt %, Ca, Sr and Mg contents of 0 wt % at an oxygen concentration of 0.8% in the cooling step. In short, the carrier core particle of Comparative Example 1 contains neither Ca, Sr, nor Mg. The Examples 1 to 12 and Comparative Example 1 were oxidized at 470° C.

[Table 1]

[Table 2]

Referring to Tables 3 and 4, Example 13 was prepared with x=0.97, Si content of 2.24 wt % and Ca content of 0.10 wt % at an oxygen concentration of 0.8% in the cooling step. Example 14 was prepared with x=0.98, Si content of 2.24 wt % and Ca content of 0.34 wt % at an oxygen concentration of 0.8% in the cooling step. Example 15 was prepared with x=0.97, Si content of 2.24 wt % and Ca content of 0.74 wt % at an oxygen concentration of 0.8% in the cooling step. Example 16 was prepared with x=0.97, Si content of 2.24 wt % and Ca content of 1.53 wt % at an oxygen concentration of 0.8% in the cooling step. On the other hand, Comparative Example 2 was prepared with x=0.97, Si content of 2.24 wt % and Ca content of 0.01 wt % at an oxygen concentration of 0.03% in the cooling step. Examples 13 to 16 and Comparative Example 2 were not oxidized.

[Table 3]

[Table 4]

The temperatures listed in oxidation conditions in the tables denote temperatures (° C.) in the above-described oxidation step. The item "Contained metal/Si" in the tables represents molar ratios of contained metal element to Si. A specific calculation to determine the molar ratio will be described below. First of all, the atomic weight of each atom is defined as follows: Si has 28.1; Mg has 24.3; Ca has 40.1; Sr has 87.6; Mn has 54.9; and Fe has 55.8. The molar ratio of the contained metal element to Si is determined by a formula: molar ratio={(weight percentage of contained metal element)/(atomic weight of contained metal element)}/{(weight percentage of contained Si)/(atomic weight of contained Si)}. Note that the average valence of Fe is as described above.

The item "core charge amount" denotes amounts of charge held by a core, or a carrier core particle. Measurement of the amount of charge will be described. 9.5 g of the carrier core particle and 0.5 g of a toner for commercial full-color copying machines were put in a 100-ml glass bottle with a cap and the bottle was placed in an environment at 25° C. and 50 RH % for 12 hours to control the moisture. The moisture-controlled carrier core particles and toner were shaken for 30 minutes by a shaker and mixed. The shaker in use was a model NEW-YS produced by YAYOI CO., LTD., and operated at a shaking speed of 200/min and at an angle of 60°. From the mixture of the carrier core particles and toner, 500 mg of the mixture was weighed out and measured for the amount of charge by a charge measurement apparatus. In this embodiment, the measurement apparatus in use was a model STC-1-C1 produced by JAPAN PIO-TECH CO., LTD., and operated at a suction pressure of 5.0 kPa with a suction mesh made of SUS and with 795 mesh. Two samples of the same were measured and the average of the measured values is defined as the core charge amount. The core charge amount is calculated by the following formula: core charge amount (μC (coulomb)/g)=measured charge (nC)$\times 10^3\times$coefficient ($1.0083\times 10^{-3}$)÷toner weight (weight before suction (g)−weight after suction (g)).

Strength is measured as follows. Thirty grams of the carrier core particles are loaded into a sample mill. The sample mill in use was model SK-M10 produced by KYORITSU RIKO KK and operated at a rotational speed of 14000 rpm for 60 seconds to conduct a crushing test. The cumulative value of carrier core pieces of 22 μm or smaller before being crushed and the cumulative value of carrier core pieces of 22 μm or smaller after being crushed were measured to determine the rate of change therebetween, and it is defined as an increasing rate of fine particles. The cumulative values are volume values measured by a laser diffraction particle size analyzer. The laser diffraction particle size distribution analyzer in use was Microtrac Model 9320-X100 produced by NIKKISO CO., LTD. The smaller the value of thus measured strength (%) is, the higher the actual strength is.

Measurement of the resistance values will be now described. The carrier core particles were placed in environments shown by the tables, specifically an environment at 10° C. and 35 RH % (LL environment) and an environment at 30° C. and 90 RH % (HH environment) for a day to control moisture, and then measured in the environments. First, two SUS (JIS) 304 plates each having a thickness of 2 mm and an electropolished surface were disposed as electrodes on a horizontally-placed insulating plate, or, for example, an acrylic plate coated with Teflon (trade mark) so that the electrodes are spaced 1 mm apart. The two electrode plates were placed so that their normal lines extend in the horizontal direction. After 200±1 mg of powder to be measured was charged in a gap between the two electrode plates, magnets having a cross-sectional area of 240 $mm^2$ were disposed behind the respective electrode plates to form a bridge made of the powder between the electrodes. While keeping the state, DC voltages were applied between the electrodes in the increasing order of the voltage values, and the value of current passing through the powder was measured by a two-terminal method to determine electric resistivity (specific resistance). For the measurement, a super megohmmeter, SM-8215 produced by HIOKI E. E. CORPORATION, was used. The electric resistivity (specific resistance) is expressed by a formula: electric resistivity (specific resistance) (Ω-cm)=measured resistance value (Ω)×cross-sectional area (2.4 $cm^2$)÷inter-electrode distance (0.1 cm). The resistivity (specific resistance) (Ω·cm) of the powder applied with the voltages listed in the tables was measured. Note that the magnets in use can be anything as long as they can cause the powder to form a bridge. In this embodiment, a permanent magnet, for example, a ferrite magnet, having a surface magnetic flux density of 1000 gauss or higher was used.

The tables show resistance values obtained under a low temperature and low humidity environment, specifically, an environment at 10° C. and 35 RH % and under a high temperature and high humidity environment, specifically, an environment at 30° C. and 90 RH %. The resistance values in the tables are represented logarithmically. In other words, the electric resistivity (specific resistance) of $1\times10^6$ Ω-cm is expressed as Log R and shown as a converted value of 6.0. The item "resistance difference between environments" shows values obtained by subtracting the resistance in the high temperature and high humidity environment from the resistance in the low temperature and low humidity environment.

The item "σ1000" in the tables indicates magnetization in an external magnetic field of 1000 Oe. The item "AD" shows bulk density (g/ml), and the item "$D_{50}$" shows volume mean diameters of the carrier core particles having a predetermined particle size distribution. The particle size distribution of the carrier core particles were measured by the aforementioned Microtrac Model 9320-X100 produced by NIKKISO CO., LTD.

Referring to Tables 1 and 2, Comparative Example 1 has a core charge amount of 1.5 μC/g, while Examples 1 to 12 have core charge amounts of 7 μC/g or more. The carrier core particles containing Ca or Sr have core charge amounts of 10 μC/g or more. The charging performance of the carrier core particles of Examples 1 to 12 has greatly improved in comparison with the carrier core particle of Comparative Example 1. For greater improvement of the charging performance, therefore, the preferable metal elements to be contained are Ca or Sr.

The strength of the carrier core particles of Examples 1 to 4 containing Ca as metal has improved in comparison with Comparative Example 1, which means that the strength was increased. The strength of Examples 9 to 12 containing Sr as metal is the same as or has greatly improved in comparison with Comparative Example 1. The strength of Examples 5 to 8 containing Mg is the same as or is slightly lower than Comparative Example 1. For greater improvement in strength, the preferable metal element to be contained is Ca.

As to the resistance difference between environments, Comparative Example 1 exhibits 1.38, while Examples 1 to 12 all exhibit 1 or less. The environmental dependency has improved in ascending order of Examples 5 to 8 containing Mg as a metal element, Examples 9 to 12 containing Sr as a metal element and Examples 1 to 4 containing Ca as a metal element. For lower environmental dependency, the preferable metal element to be contained is Ca.

Examples 1 to 12 all have a magnetization of 50 emu/g or higher, and therefore have no problems in practical use.

Referring to Tables 3 and 4, Comparative Example 2 is formulated to contain 0.01 wt % Ca. Examples 13 to 16 and Comparative Example 2 were fired at a temperature different from Examples 1 to 12 and Comparative Example 2 in Tables 1 and 2 and were not oxidized. In addition, Examples 13 to 16 and Comparative Example 2 have greater median diameters $D_{50}$.

Referring to Tables 3 and 4, Comparative Example 2 has a core charge amount of 0.1 μC/g, while Examples 13 to 16 all have 2.0 μC/g or more. The charging performance of the carrier core particles of Examples 13 to 16 has greatly improved in comparison with the carrier core particle of Comparative Example 2.

Examples 13 to 16 are as strong as or slightly less strong than Comparative Example 2.

As to the resistance difference between environments, Comparative Example 2 exhibits 1.02, while Examples 13 to 16 all exhibit 0.9 or less. Especially, the resistance difference between environments of Example 14 is 0.08 that is almost nothing and indicates that the environmental dependency has been reduced.

Examples 13 to 16 all have a magnetization of 50 emu/g or higher and therefore have no problems in practical use.

Figure 5:
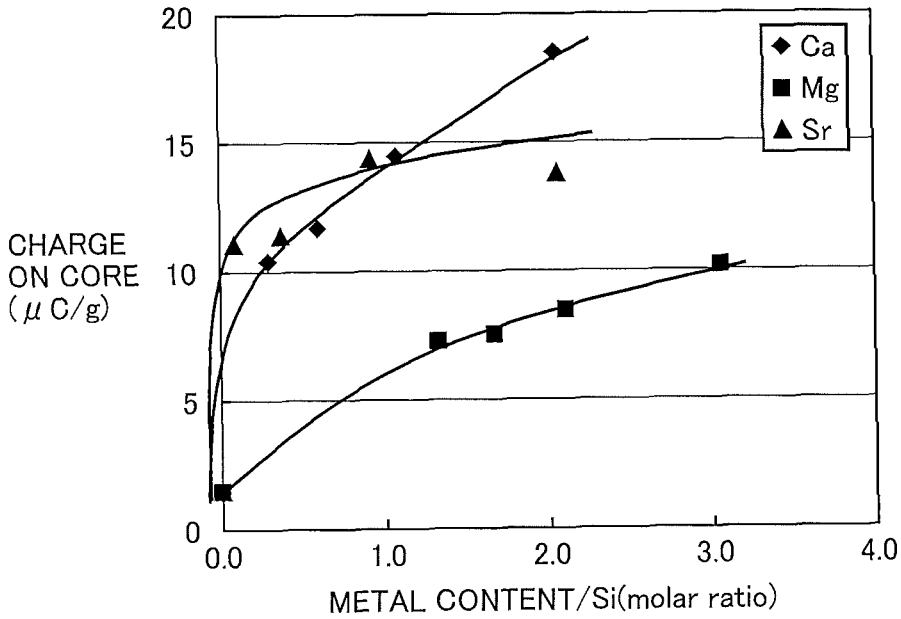
FIG. 5 is a graph showing the relationship between the amount of charge of the core and the content ratio of metals contained.

FIG. 5 is a graph showing the relationship between core charge amounts and content ratios of metals of aforementioned Examples. In FIG. 5, the vertical axis indicates the core charge amounts, while the horizontal axis indicates the content ratios of the contained metals. FIG. 5 shows that the core charge amounts increase with an increase in the content ratios of the respective metal elements.

Figure 6:
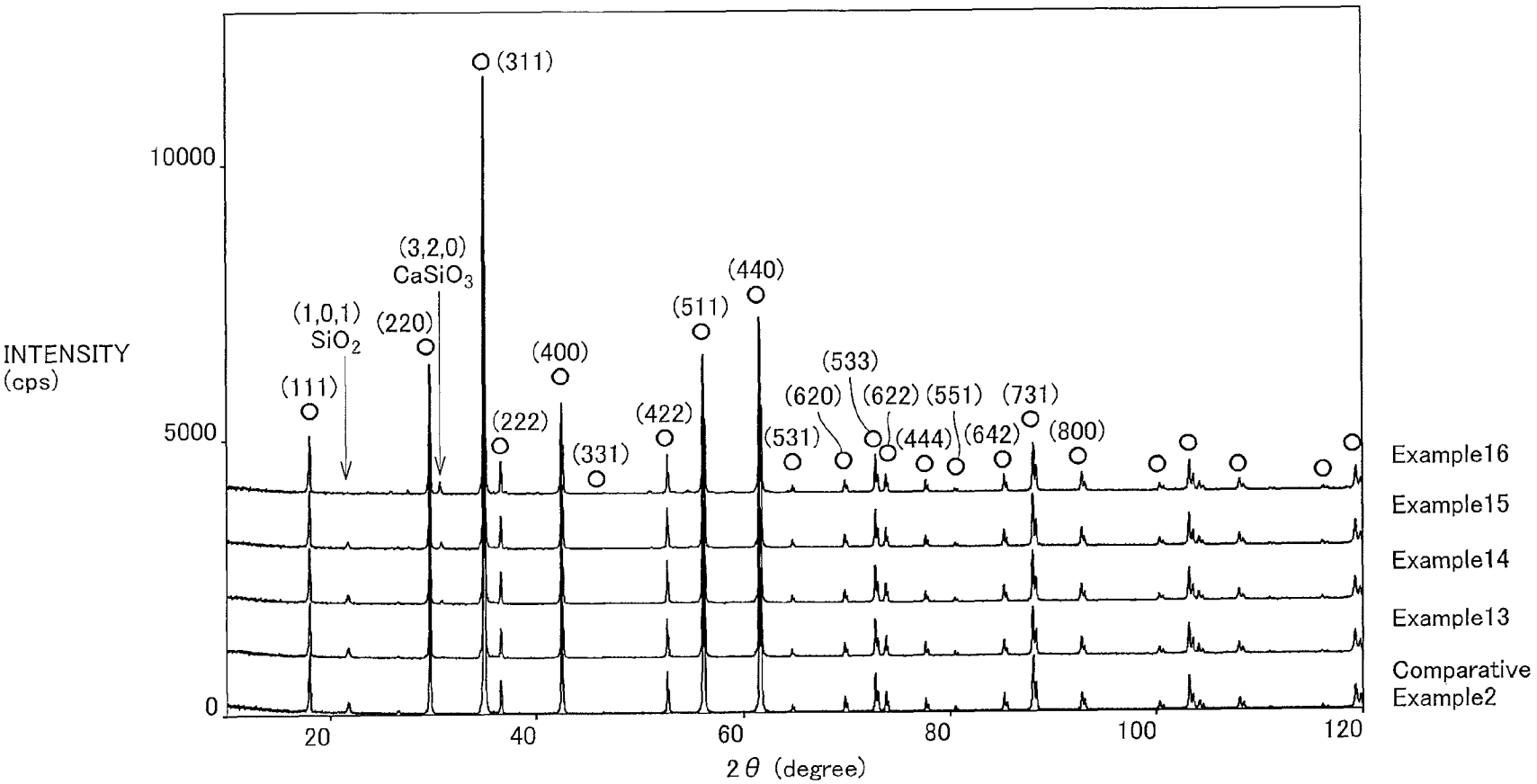
FIG. 6 is an X-Ray Diffraction (hereinafter, sometimes simply referred to as "XRD") chart of powder of the carrier core particles.

The principle of the present invention will be contemplated below. FIG. 6 is a chart plotted with powder XRD results of the carrier core particles of Examples 13 to 16 and Comparative Example 2. In FIG. 6, the horizontal axis represents 20 (degree), while the vertical axis represents intensity (cps (count per second)). The XRD was conducted under the following measurement conditions: the X-ray diffractometer in use was Ultima IV produced by Rigaku Corporation; the X-ray source was Cu; the acceleration voltage was 40 kV; the current was 40 mA; the divergence slit angle was 1°; the scattering slit angle was 1°; the receiving slit width was 0.3 mm; the scanning mode was step scanning; the step width was 0.0200°; the count time was 1.0 second; and the number of integration was 1. FIG. 6 shows the pattern images of Comparative Example 2, Example 13, Example 14, Example 15 and Example 16 in this order from below with a predetermined space therebetween. FIG. 6 also shows a peak position representing the existence of $SiO_2$ and a peak position representing the existence of $CaSiO_3$ by arrows.

Referring to Table 3 and FIG. 6, the order of Ca content from lowest to highest is Comparative Example 2, Example 13, Example 14, Example 15 and Example 16, and it is found that the higher the Ca content is, the more distinctly the peak of $CaSiO_3$ appears. It is also found that the peaks of $SiO_2$ gradually disappear in the aforementioned order. Comparisons of the patterns in the XRD chart show that increase in amount of Ca decreases the crystal structure of $SiO_2$ and increases the crystal structure of $CaSiO_3$ in the carrier core particle.

Examples 1 to 12 contain too small an amount of Si, Ca, Sr and Mg to detect the peak of complex metal oxides made of Si and the contained metal by the XRD. In order to check whether synthesis of the complex metal oxide containing Si is achieved or not, the following analysis method was conducted. The prepared carrier core particles were pulverized into particles of approximately 1 μm by a vibrating mill, bead mill or other types of mills, and the particles were magnetically separated to collect non-magnetic particles. As a result of XRD analysis on the collected non-magnetic particles, the complex metal oxides containing Si and a metal in Examples 1 to 12 were identified, but the complex metal oxide containing Si and a metal in Comparative Example 1 was not identified. This analysis proved that the synthesis of the complex metal oxides is achieved in the carrier core particles of Examples 1 to 12, but not in the carrier core particle of Comparative Example 1.

Figure 7:
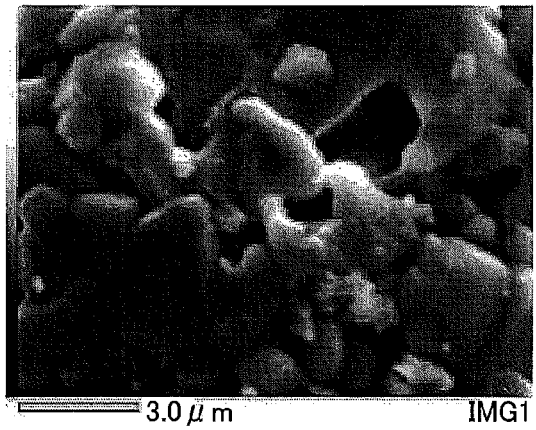
FIG. 7 is an electron micrograph showing the external appearance of a carrier core particle of Comparative Example 2.
Figure 8:
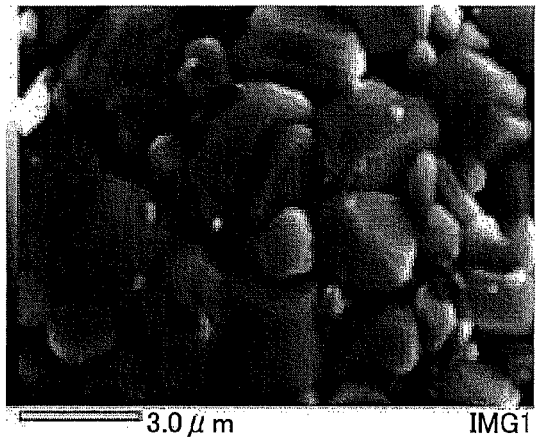
FIG. 8 is an electron micrograph showing the external appearance of a carrier core particle of Example 14.
Figure 9:
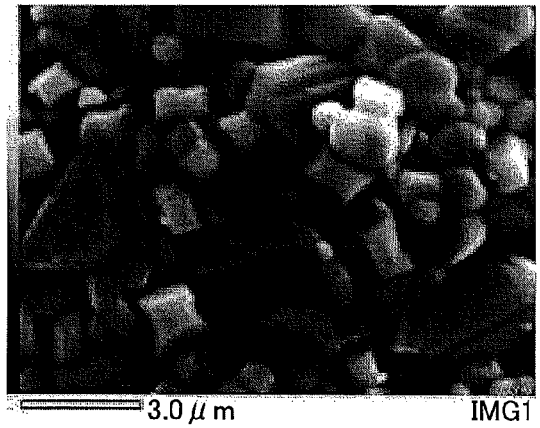
FIG. 9 is an electron micrograph showing the external appearance of a carrier core particle of Example 16.
Figure 10:
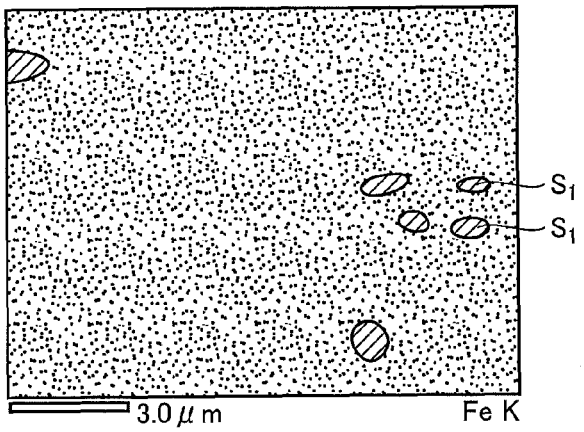
FIG. 10 is a schematic diagram showing an EDX elemental analysis result of an Fe element within the visible range of the electron micrograph in FIG. 7.
Figure 11:
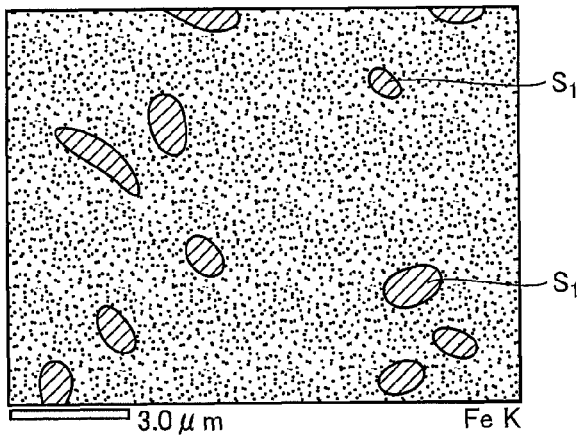
FIG. 11 is a schematic diagram showing an EDX elemental analysis result of an Fe element within the visible range of the electron micrograph in FIG. 8.
Figure 12:
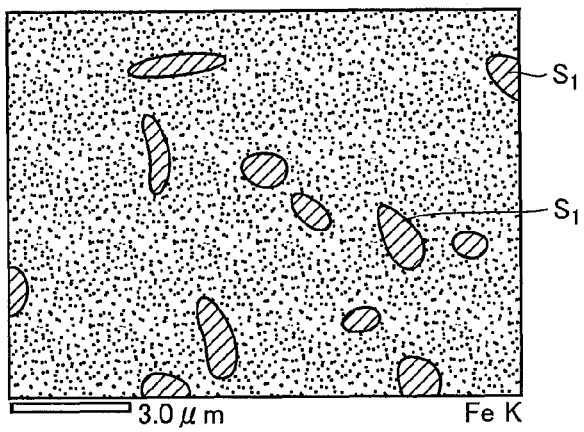
FIG. 12 is a schematic diagram showing an EDX elemental analysis result of an Fe element within the visible range of the electron micrograph in FIG. 9.
Figure 13:
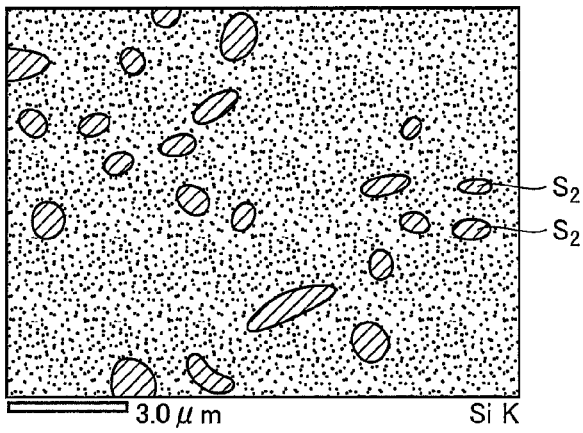
FIG. 13 is a schematic diagram showing an EDX elemental analysis result of an Si element within the visible range of the electron micrograph in FIG. 7.
Figure 14:
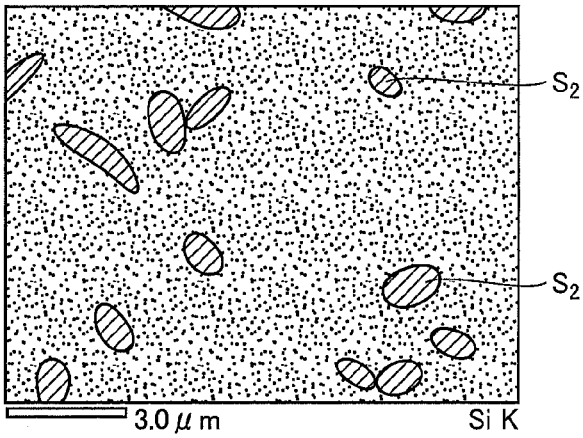
FIG. 14 is a schematic diagram showing an EDX elemental analysis result of an Si element within the visible range of the electron micrograph in FIG. 8.
Figure 15:
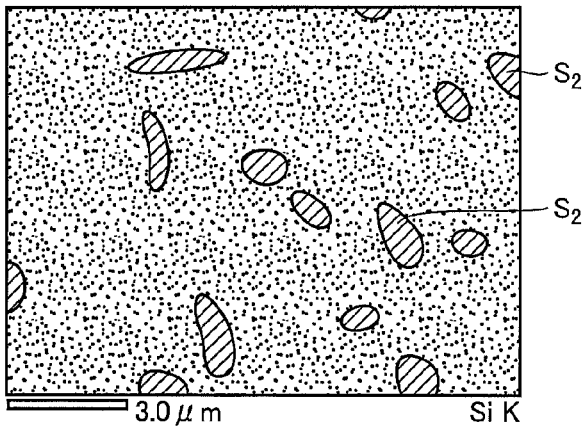
FIG. 15 is a schematic diagram showing an EDX elemental analysis result of an Si element within the visible range of the electron micrograph in FIG. 9.
Figure 16:
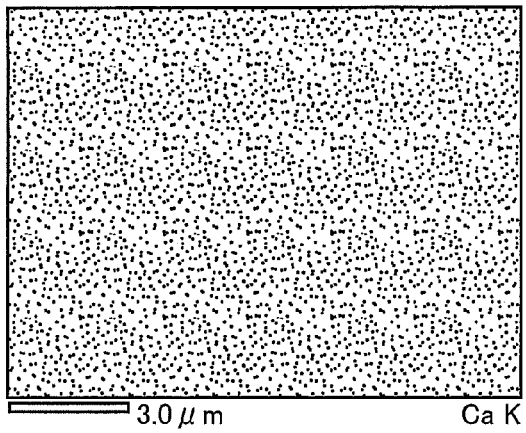
FIG. 16 is a schematic diagram showing an EDX elemental analysis result of a Ca element within the visible range of the electron micrograph in FIG. 7.
Figure 17:
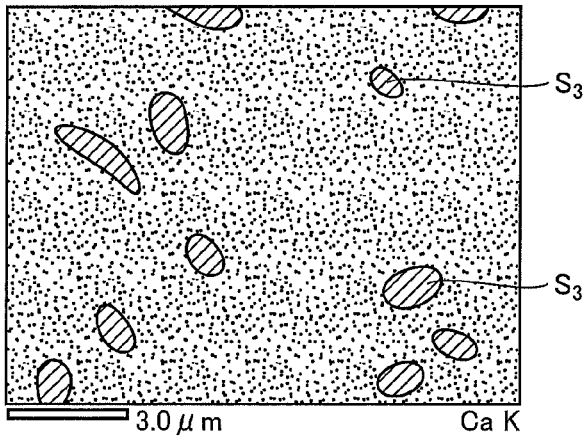
FIG. 17 is a schematic diagram showing an EDX elemental analysis result of a Ca element within the visible range of the electron micrograph in FIG. 8.
Figure 18:
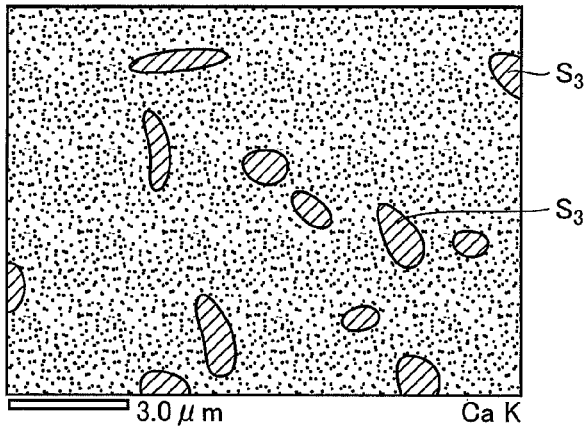
FIG. 18 is a schematic diagram showing an EDX elemental analysis result of a Ca element within the visible range of the electron micrograph in FIG. 9.

FIGS. 7 to 9 are electron micrographs showing the surfaces of the carrier core particles of Comparative Example 2, Example 14 and Example 16, respectively. FIGS. 10 to 12 are schematic diagrams showing EDX (Energy Dispersive X-ray spectroscopy) elemental analysis results on an Fe element within visible ranges of the electron micrographs in FIG. 7 to FIG. 9. FIGS. 13 to 15 are schematic diagrams showing EDX elemental analysis results on an Si element within visible ranges of the electron micrographs in FIGS. 7 to 9. FIGS. 16 to 18 are schematic diagrams showing EDX elemental analysis results on a Ca element within visible ranges of the electron micrographs in FIGS. 7 to 9.

Areas $S_2$ with a hatch pattern in FIGS. 10 to 12 are areas having a relatively small amount of Fe, Areas $S_2$ with a hatch pattern in FIGS. 13 to 15 are areas having a relatively large amount of Si, and Areas $S_3$ with a hatch pattern in FIGS. 16 to 18 are areas having a relatively large amount of Ca.

Referring to FIGS. 7 to 9 and FIGS. 10 to 12, it appears that the surface appearances of the carrier core particles are not greatly different from each other. It has been found that the areas having a small amount of Fe increase in the order of Comparative Example 2, Example 14 and Example 16. Referring also to FIGS. 13 to 15, there is almost no difference in the areas having a large amount of Si. Furthermore, FIGS. 16 to 18 show that the areas having a large amount of Ca increase on Areas S1 with a hatch pattern in FIGS. 10 to 12, or in other words, the areas having a small amount of Fe.

From a consideration of FIGS. 7 to 18, great differences in the amount of Si are not seen among the surfaces of the carrier core particles of Comparative Example 2, Example 14 and Example 16; however, the areas where Ca increases, the areas where Fe decreases and the areas where Si is present are mostly overlapped thereon. This indicates that Si on the surface of the carrier core particle of Comparative Example 2 is single Si element or an oxide like $SiO_2$, but with increase in the amount of Ca, Si on the surface of the carrier core particle exists as a compound of Ca, for example, as $CaSiO_3$ which is a complex metal oxide of Si. Possible complex metal oxides of Si and Mg include, for example, $MgSiO_3$ and $Mg_2SiO_4$, complex metal oxides of Si and Ca include, for example, $CaSiO_a$, $Ca_2SiO_4$, $Ca_3Si_2O_7$, $Ca_3SiO_5$, and complex metal oxides of Si and Sr include, for example, $SrSiO_3$, $Sr_2SiO_4$ and $Sr_3SiO_5$. Tables 2 and 4 show the structures of possible complex metal oxides of Si and the metals and the crystal structures of the main components.

The results of EDX are used to examine the surfaces of the carrier core particles, but it is conjectured that the interiors of the carrier core particles have the same structure. It is also conjectured that a complex metal oxide of Si and the contained metal, such as $CaSiO_3$, is formed in the inner layer of the carrier core particle, and the complex metal oxide of Si and the metal holds triboelectric charge, thereby enhancing charging performance of the entire carrier core particle. Even if a metal element is excessively added to the carrier core particle, the metal element holds the triboelectric charge, thereby enhancing the charging performance of the carrier core particle. Mg, Ca or Sr is present in the form of a complex metal oxide of Si; however, they can be partially present in a solid solution in the spinel structure.

The manufacturing method of the embodiment includes preparing at least one of a raw material containing calcium, a raw material containing strontium and a raw material containing magnesium, a raw material containing manganese, a raw material containing iron and a raw material containing silicon, and mixing them to obtain the carrier core particle according to the present invention; however, the present invention is not limited thereto. For example, a metal oxide of Si, such as $CaSiO_3$, is prepared and mixed with them to obtain the carrier core particle according to the invention.

In the embodiment, the carrier core particle can contain two or more metal elements, such as Ca and Sr, selected from the group consisting of Ca, Sr and Mg. Furthermore, Ba can be contained as a metal element.

In the embodiment, the oxygen concentration during the cooling operation in the firing step is set higher than a predetermined concentration to add an excess amount y of oxygen to the carrier core particle; however, the present invention is not limited thereto. For example, the excess amount of oxygen can be added to the carrier core particle by adjusting the compounding ratio of the raw materials in the mixing step. Alternatively, oxygen can be excessively added to the carrier core particle by performing the step of accelerating the sintering reaction, which is executed before the cooling step, under the same atmosphere as in the cooling step.

The foregoing has described the embodiment of the present invention by referring to the drawings. However, the invention should not be limited to the illustrated embodiment. It should be appreciated that various modifications and changes can be made to the illustrated embodiment within the scope of the appended claims and their equivalents.

INDUSTRIAL APPLICABILITY

The carrier core particle for an electrophotographic developer according to the invention, the carrier for the electrophotographic developer and the electrophotographic developer can be effectively used when applied to copying machines or the like in various usage environments.

REFERENCE SIGNS LIST

11: carrier core particle
12: carrier
13: developer
14: toner.

TABLE 1

| | Firing conditions | | | Core composition | | | | | | | | | |
|---|---|---|---|---|---|---|---|---|---|---|---|---|---|
| | Firing temperature ° C. | Oxygen concentration during cooling % | Oxidation temperature ° C. | Si wt % | Sr wt % | Ca wt % | Mg wt % | Fe wt % | Mn wt % | Contained metal/Si molar ratio | Average valence of Fe | x | y |
| Example 1 | 1130 | 0.8 | 470 | 0.11 | — | 0.05 | — | 51 | 20 | 0.29 | 2.997 | 0.85 | 0.07 |
| Example 2 | 1130 | 0.8 | 470 | 0.11 | — | 0.09 | — | 51 | 20 | 0.59 | 2.998 | 0.85 | 0.07 |
| Example 3 | 1130 | 0.8 | 470 | 0.11 | — | 0.17 | — | 51 | 20 | 1.07 | 3.000 | 0.85 | 0.07 |
| Example 4 | 1130 | 0.8 | 470 | 0.11 | — | 0.33 | — | 51 | 20 | 2.05 | 3.000 | 0.85 | 0.07 |
| Example 5 | 1130 | 0.8 | 470 | 0.11 | — | — | 0.13 | 52 | 20 | 1.33 | 2.992 | 0.85 | 0.07 |
| Example 6 | 1130 | 0.8 | 470 | 0.11 | — | — | 0.16 | 51 | 20 | 1.67 | 2.998 | 0.85 | 0.07 |
| Example 7 | 1130 | 0.8 | 470 | 0.11 | — | — | 0.20 | 51 | 20 | 2.10 | 3.000 | 0.85 | 0.07 |
| Example 8 | 1130 | 0.8 | 470 | 0.11 | — | — | 0.30 | 51 | 20 | 3.06 | 3.000 | 0.85 | 0.08 |
| Example 9 | 1130 | 0.8 | 470 | 0.11 | 0.03 | — | — | 51 | 20 | 0.09 | 3.000 | 0.85 | 0.08 |
| Example 10 | 1130 | 0.8 | 470 | 0.11 | 0.13 | — | — | 51 | 20 | 0.37 | 3.000 | 0.85 | 0.08 |
| Example 11 | 1130 | 0.8 | 470 | 0.11 | 0.32 | — | — | 51 | 20 | 0.91 | 3.000 | 0.85 | 0.07 |
| Example 12 | 1130 | 0.8 | 470 | 0.11 | 0.72 | — | — | 51 | 20 | 2.06 | 3.000 | 0.86 | 0.07 |
| Comparative Example 1 | 1130 | 0.8 | 470 | 0.11 | 0 | 0 | 0 | 51 | 20 | 0.00 | 2.993 | 0.85 | 0.07 |

TABLE 2

| | Core charge amount μC/g | Strength % | Resistance under HH environment (30° C., 90%) 500 V/cm | Resistance under LL environment (10° C., 35%) 500 V/cm | Resistance under HH environment (30° C., 90%) 1000 V/cm | Resistance under LL environment (10° C., 35%) 1000 V/cm | Resistance difference between environments | σ1000 emu/g | AD g/ml | $D_{50}$ μm | Crystal structure | Si-containing complex metal oxide |
|---|---|---|---|---|---|---|---|---|---|---|---|---|
| Example 1 | 10.4 | 2 | — | — | 8.15 | 8.68 | 0.53 | 60 | 2.3 | 25 | $MnFe_2O_4$ $Fe_3O_4$ $Fe_2O_3$ | $CaSiO_3$ or $Ca_3SiO_5$ |
| Example 2 | 11.7 | 5 | — | — | 8.03 | 8.44 | 0.40 | 61 | 2.3 | 25 | $MnFe_2O_4$ $Fe_3O_4$ $Fe_2O_3$ | $CaSiO_3$ or $Ca_3SiO_5$ |
| Example 3 | 14.5 | 6 | — | — | 8.24 | 8.67 | 0.43 | 60 | 2.3 | 25 | $MnFe_2O_4$ $Fe_3O_4$ $Fe_2O_3$ | $CaSiO_3$ or $Ca_3SiO_5$ |
| Example 4 | 18.5 | 5 | — | — | 8.32 | 8.79 | 0.46 | 53 | 2.3 | 25 | $MnFe_2O_4$ $Fe_3O_4$ $Fe_2O_3$ | $CaSiO_3$ or $Ca_3SiO_5$ |
| Example 5 | 7.3 | 9 | — | — | 8.53 | 9.30 | 0.78 | 59 | 2.3 | 25 | $MnFe_2O_4$ $Fe_3O_4$ $Fe_2O_3$ | $MgSiO_3$ or $Mg_2SiO_4$ |
| Example 6 | 7.5 | 10 | — | — | 8.39 | 9.36 | 0.97 | 59 | 2.3 | 25 | $MnFe_2O_4$ $Fe_3O_4$ $Fe_2O_3$ | $MgSiO_3$ or $Mg_2SiO_4$ |
| Example 7 | 8.5 | 13 | — | — | 8.36 | 9.34 | 0.98 | 59 | 2.3 | 25 | $MnFe_2O_4$ $Fe_3O_4$ $Fe_2O_3$ | $MgSiO_3$ or $Mg_2SiO_4$ |
| Example 8 | 10.2 | 13 | — | — | 8.35 | 9.35 | 0.99 | 59 | 2.3 | 25 | $MnFe_2O_4$ $Fe_3O_4$ $Fe_2O_3$ | $MgSiO_3$ or $Mg_2SiO_4$ |
| Example 9 | 11.1 | 10 | — | — | 7.93 | 8.55 | 0.62 | 60 | 2.3 | 25 | $MnFe_2O_4$ $Fe_3O_4$ $Fe_2O_3$ | $SrSiO_3$ or $Sr_2SiO_4$ or $Sr_3SiO_5$ |
| Example 10 | 11.4 | 4 | — | — | 7.93 | 8.69 | 0.77 | 58 | 2.3 | 25 | $MnFe_2O_4$ $Fe_3O_4$ $Fe_2O_3$ | $SrSiO_3$ or $Sr_2SiO_4$ or $Sr_3SiO_5$ |
| Example 11 | 14.4 | 5 | — | — | 8.33 | 8.98 | 0.65 | 58 | 2.3 | 25 | $MnFe_2O_4$ $Fe_3O_4$ $Fe_2O_3$ | $SrSiO_3$ or $Sr_2SiO_4$ or $Sr_3SiO_5$ |
| Example 12 | 13.8 | 3 | — | — | 8.31 | 9.01 | 0.70 | 55 | 2.2 | 25 | $MnFe_2O_4$ $Fe_3O_4$ $SrFe_2O_{19}$ | $SrSiO_3$ or $Sr_2SiO_4$ or $Sr_3SiO_5$ |
| Comparative Example 1 | 1.5 | 10 | — | — | 8.03 | 9.41 | 1.38 | 57 | 2.1 | 25 | $MnFe_2O_4$ $Fe_3O_4$ $Fe_2O_3$ | — |

TABLE 3

| | Firing conditions | | | Core composition | | | | | | | | | |
|---|---|---|---|---|---|---|---|---|---|---|---|---|---|
| | Firing temperature ° C. | Oxygen concentration during cooling % | Oxidation temperature ° C. | Si wt % | Sr wt % | Ca wt % | Mg wt % | Fe wt % | Mn wt % | Contained metal/Si molar ratio | Average valence of Fe | x | y |
| Example 13 | 1100 | 0.8 | — | 2.24 | — | 0.10 | — | 47 | 22 | 0.03 | 3.000 | 0.97 | 0.01 |
| Example 14 | 1100 | 0.8 | — | 2.24 | — | 0.34 | — | 47 | 22 | 0.11 | 2.997 | 0.98 | 0.01 |
| Example 15 | 1100 | 0.8 | — | 2.24 | — | 0.74 | — | 46 | 22 | 0.23 | 2.995 | 0.97 | 0.01 |

TABLE 3-continued

| | Firing conditions | | | Core composition | | | | | | | | | |
|---|---|---|---|---|---|---|---|---|---|---|---|---|---|
| | Firing temperature ° C. | Oxygen concentration during cooling % | Oxidation Oxidation temperature ° C. | Si wt % | Sr wt % | Ca wt % | Mg wt % | Fe wt % | Mn wt % | Contained metal/Si molar ratio | Average valence of Fe | x | y |
| Example 16 | 1100 | 0.8 | — | 2.24 | — | 1.53 | — | 46 | 22 | 0.48 | 2.992 | 0.97 | 0.01 |
| Comparative Example 2 | 1100 | 0.03 | — | 2.24 | — | 0.01 | — | 47 | 22 | 0.01 | 2.980 | 0.97 | 0.00 |

TABLE 4

| | Core charge amount μC/g | Strength % | Resistance under HH environment (30° C., 90%) 500 V/cm | Resistance under LL environment (10° C., 35%) 500 V/cm | Resistance under HH environment (30° C., 90%) 1000 V/cm | Resistance under LL environment (10° C., 35%) 1000 V/cm | Resistance difference between environments | σ1000 emu/g | AD g/ml | $D_{50}$ μm | Crystal structure | Si-containing complex metal oxide |
|---|---|---|---|---|---|---|---|---|---|---|---|---|
| Example 13 | 2.1 | 10 | 7.93 | 8.64 | — | — | 0.70 | 62 | 2.3 | 35 | $MnFe_2O_4$ $Fe_3O_4$ | $CaSiO_3$ or $Ca_3SiO_5$ |
| Example 14 | 3.0 | 11 | 8.07 | 8.15 | — | — | 0.08 | 62 | 2.3 | 35 | $MnFe_2O_4$ $Fe_3O_4$ | $CaSiO_3$ or $Ca_3SiO_5$ |
| Example 15 | 2.3 | 15 | 7.50 | 8.35 | — | — | 0.85 | 62 | 2.3 | 35 | $MnFe_2O_4$ $Fe_3O_4$ | $CaSiO_3$ or $Ca_3SiO_5$ |
| Example 16 | 2.8 | 11 | 7.74 | 8.62 | — | — | 0.88 | 61 | 2.2 | 35 | $MnFe_2O_4$ $Fe_3O_4$ | $CaSiO_3$ or $Ca_3SiO_5$ |
| Comparative Example 2 | 0.1 | 10 | 7.34 | 8.36 | — | — | 1.02 | 64 | 2.2 | 35 | $MnFe_2O_4$ $Fe_3O_4$ | — |

The invention claimed is:

1. A carrier core particle for an electrophotographic developer comprising:

a core composition expressed by a general formula: $Mn_xFe_{3-x}O_{4+y}$ ($0<x\leq1$, $0<y$) as a main ingredient;

0.1 wt % or more of Si; and 0.03 wt % or more of at least one metal element selected from the group consisting of Ca and Sr, wherein at least a part of the metal element exists as a complex metal oxide of Si, the complex metal oxide of Si being at least one selected from the group consisting of $CaSiO_3$, $Ca_2SiO_4$, $Ca_3SiO_2O_7$, $Ca_3SiO_5$, $SrSiO_3$, $Sr_2SiO_4$ and $Sr_3SiO_5$.

2. The carrier core particle for the electrophotographic developer according to claim 1, wherein the molar ratio of the contained metal element to Si is 0.09 or higher.

3. A carrier for an electrophotographic developer used to develop electrophotographic images, comprising:

a carrier core particle including a core composition expressed by a general formula: $Mn_xFe_{3-x}O_{4+y}$ ($0<x\leq1$, $0<y$) as a main ingredient, 0.1 wt % or more of Si, and 0.03 wt % or more of at least one metal element selected from the group consisting of Ca and Sr, wherein at least a part of the metal element exists as a complex metal oxide of Si, the complex metal oxide of Si being at least one selected from the group consisting of $CaSiO_3$, $Ca_2SiO_4$, $Ca_3SiO_2O_7$, $Ca_3SiO_5$, $SrSiO_3$, $Sr_2SiO_4$, and $Sr_3SiO_5$; and a resin that coats the surface of the carrier core particle.

4. An electrophotographic developer used to develop electrophotographic images, comprising:

a carrier including a carrier core particle having a core composition expressed by a general formula: $Mn_xFe_{3-x}O_{4+y}$ ($0<x\leq1$, $0<y$) as a main ingredient, 0.1 wt % or more of Si, and 0.03 wt % or more of at least one metal element selected from the group consisting of Ca and Sr, and wherein at least a part of the metal element exists as a complex metal oxide of Si, the complex metal oxide of Si being at least one selected from the group consisting of $CaSiO_3$, $Ca_2SiO_4$, $Ca_3SiO_2O_7$, $Ca_3SiO_5$, $SrSiO_3$, $Sr_2SiO_4$ and $Sr_3SiO_5$, and a resin that coats the surface of the carrier core particle; and a toner that can be triboelectrically charged by frictional contact with the carrier for development of electrophotographic images.

* * * * *

UNITED STATES PATENT AND TRADEMARK OFFICE

CERTIFICATE OF CORRECTION

PATENT NO. : 8,865,386 B2
APPLICATION NO. : 13/579777
DATED : October 21, 2014
INVENTOR(S) : Kawauchi et al.

It is certified that error appears in the above-identified patent and that said Letters Patent is hereby corrected as shown below:

In the claims

Column 21, line 45, Claim 1:
"$Ca_3SiO_2O_7$" should read
"$Ca_3Si_2O_7$"

Column 22, line 36, Claim 3:
"$Ca_3SiO_2O_7$" should read
"$Ca_3Si_2O_7$"

Column 22, line 50, Claim 4:
"$Ca_3SiO_2O_7$" should read
"$Ca_3Si_2O_7$"

Signed and Sealed this
Twenty-fourth Day of November, 2015

Michelle K. Lee

Michelle K. Lee
*Director of the United States Patent and Trademark Office*